US008680786B2

(12) United States Patent
Choi et al.

(10) Patent No.: US 8,680,786 B2
(45) Date of Patent: Mar. 25, 2014

(54) METHOD AND APPARATUS FOR COMMON USE OF POWER SUPPLY AND DISPLAY APPARATUS USING THE SAME

(75) Inventors: Hyo-soon Choi, Suwon-si (KR); Jeong-il Kang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 413 days.

(21) Appl. No.: 13/185,947

(22) Filed: Jul. 19, 2011

(65) Prior Publication Data

US 2012/0038290 A1 Feb. 16, 2012

(30) Foreign Application Priority Data

Aug. 16, 2010 (KR) ..... 10-2010-0078897

(51) Int. Cl.
*G05F 1/00* (2006.01)

(52) U.S. Cl.
USPC ..... 315/302; 315/291; 315/247; 315/307; 345/204; 345/212; 345/102; 345/690

(58) Field of Classification Search
USPC ..... 315/287, 247, 291, 204, 302, 307, 311, 315/312; 345/102, 204, 211, 212, 690, 691; 323/234
See application file for complete search history.

(56) References Cited

U.S. PATENT DOCUMENTS

| | | | | |
|---|---|---|---|---|
| 5,371,439 | A | 12/1994 | Griffin | |
| 7,358,685 | B2 * | 4/2008 | Lee | 315/287 |
| 7,738,928 | B2 * | 6/2010 | Veselic | 455/572 |
| 7,874,715 | B2 * | 1/2011 | Baek et al. | 362/612 |
| 8,077,137 | B2 * | 12/2011 | Lee | 345/102 |
| 8,259,097 | B2 * | 9/2012 | Kim et al. | 345/212 |
| 8,421,929 | B2 * | 4/2013 | Joo et al. | 348/730 |
| 8,493,001 | B2 * | 7/2013 | Yang et al. | 315/307 |
| 2009/0015174 | A1 | 1/2009 | Huang et al. | |
| 2009/0122003 | A1 | 5/2009 | Chen et al. | |

OTHER PUBLICATIONS

Search Report dated Oct. 11, 2011, from the European Patent Office issued in counterpart European Application No. 11173872.0.

* cited by examiner

*Primary Examiner* — Haiss Philogene
(74) *Attorney, Agent, or Firm* — Sughrue Mion, PLLC

(57) ABSTRACT

An apparatus and a method for common use of a power supply and a display apparatus using the same are provided. The display apparatus includes a display panel, a backlight unit which provides backlight to the display panel, and a power supply unit for common use which comprises an adjusting circuit unit comprising a plurality of resistances, and provides a current of a magnitude corresponding to a combination state of the plurality of resistances to the backlight unit. Accordingly, the power supply apparatus for common use adjusts an output current easily and is commonly used for diverse display apparatuses, and thus a manufacturing process is efficiently improved.

16 Claims, 11 Drawing Sheets

FIG. 6

| TYPE | INCH | WIRE CONNECTING METHOD (140) | PMW Controller (Vin) (120) | LED OUTPUT CURRENT(mA) |
|---|---|---|---|---|
| 4-1 | W | Open | V*(R2+R3+VR)/(R1+R2+R3+VR) | w |
| 4-2 | X | ⓐ-ⓑ Short | V*(R3+VR)/(R1+R3+VR) | x |
| 4-3 | Y | ⓑ-ⓒ Short | V*(R2+VR)/(R1+R2+VR) | y |
| 4-4 | Z | ⓐ-ⓒ Short | V*(VR)/(R1+VR) | z |

METHOD AND APPARATUS FOR COMMON USE OF POWER SUPPLY AND DISPLAY APPARATUS USING THE SAME

CROSS-REFERENCE TO RELATED APPLICATION

This application claims priority from Korean Patent Application No. 10-2010-0078897, filed on Aug. 16, 2010, in the Korean Intellectual Property Office, the disclosure of which is incorporated herein by reference in its entirety.

BACKGROUND

1. Field

Methods and apparatuses consistent with exemplary embodiments relate to a method and an apparatus for common use of a power supply and a display apparatus using the same, and more particularly, to a method and an apparatus for common use of a power supply, which are capable of changing an output current according to a size of a display panel, and a display apparatus using the same.

2. Description of the Related Art

Since display apparatus are applied in various fields, from a small size MP3 player to a large size billboard, the size required by each application device also varies. For example, in the past, the size of a television did not exceed a predetermined size, but today, thanks to the rapid development of TV production technologies, a TV is large enough to serve as a screen of a movie theater.

Also, various technologies for improving image quality are being developed along with the growing size of the display apparatus, and in particular, the development of flat panel display apparatuses is being accelerated. Among the flat panel display apparatuses, a liquid crystal display (LCD) is increasingly used and also various light sources, such as a backlight unit (BLU), for supplying backlight to a display panel in order to display an image on the LCD, are being used. In particular, a light source having the advantage of low power consumption and an ability to emit light uniformly has been developed and recently a light emitting diode (LED) is being focused on.

The backlight unit should have different configurations and sizes according to the size of a display panel. Also, a magnitude of a current for driving the backlight unit should be changed according to the size and the configuration of the backlight unit. In this case, a switched-mode power supply (SMPS), which is a power supply for driving the backlight unit, should set an output current differently according to the size and the configuration of the backlight unit.

In the related art, a single SMPS has difficulty in supplying output currents as required by diverse display apparatuses. Therefore, a method for adjusting the output current manually using a plurality of SMPSs has been adopted. In this case, since a different SMPS should be used according to the size of a display apparatus and all processes should be performed manually, there are many problems such as waste of human resources and low productivity.

In particular, in order to meet today's trend toward mass production of display apparatuses of diverse sizes, there is a demand for a method for easily adjusting an output current according to the size of each display apparatus.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide an apparatus and a method for common use of a power supply, which are capable of adjusting an output current easily and thus being commonly used in various display apparatuses, and a display apparatus using the same.

According to an aspect of an exemplary embodiment, there is provided a power supply apparatus for common use, including: a power supply unit, a controller which controls the power supply unit, and an adjusting circuit unit which adjusts a voltage to be supplied to the controller using a plurality of resistances which are combinable in different ways, thereby adjusting a magnitude of a current output from the power supply unit.

The plurality of resistances may be combinable so that a current, a magnitude of which is changeable according to a display size of a display apparatus to which the power supply apparatus is applied, is output.

The adjusting circuit unit may include: a voltage source, the plurality of resistances which are connected between both ends of the voltage source in series, and a plurality of connecting nodes which are formed by connection between the voltage source and the plurality of resistances, and the plurality of connecting nodes may be selectively connected so that a connection relationship between the plurality of resistances is changed.

The power supply apparatus may further include a connector unit which connects the power supply unit to a backlight unit, and the connector unit may be connected to the plurality of connecting nodes so as to change the connection relationship between the plurality of resistances.

The backlight unit may include a light emitting diode (LED) light source and the power supply unit and the connector part may be connected to each other via a wire harness.

According to an aspect of another exemplary embodiment, there is provided a display apparatus including: a display panel, a backlight unit which provides backlight to the display panel, and a power supply unit for common use which includes an adjusting circuit unit including a plurality of resistances, and provides a current of a magnitude corresponding to a combination state of the plurality of resistances to the backlight unit.

The plurality of resistances may be combinable so that a current having a magnitude which is changeable according to a size of the display panel is output.

A combination state of the plurality of resistances is adjustable.

The display apparatus may further include a connector unit which connects the power supply unit and the backlight unit, and the connector unit may include a plurality of connecting points connected to connecting nodes formed between the plurality of resistances, and the combination state of the plurality of resistances may be adjusted according to a connection state between the plurality of connecting points.

The connector unit may be connected to the power supply unit via a wire harness.

The plurality of resistances may be at least three resistances.

The backlight unit may include an LED light source.

According to an aspect of another exemplary embodiment, there is provided a power supplying method for common use of a display apparatus including a power supply unit for common use for supplying a current to a backlight unit, the method including: changing an output current by adjusting an adjusting circuit unit including a plurality of resistances, and supplying the changed current to the backlight unit.

The plurality of resistances may be combinable so that a current having a magnitude which is changeable according to a panel size of the display apparatus is output.

The changing the current may include changing a combination state of the plurality of resistances by adjusting a connector unit which is included in the display apparatus to connect the power supply unit and the backlight unit.

The connector unit may be connected to the power supply unit via a wire harness, the plurality of resistances may be at least three resistances, and the backlight unit may include an LED light source.

Additional aspects and advantages of the exemplary embodiments will be set forth in the detailed description, will be obvious from the detailed description, or may be learned by practicing the exemplary embodiments.

BRIEF DESCRIPTION OF THE DRAWING FIGURES

The above and/or other aspects will be more apparent by describing in detail exemplary embodiments, with reference to the accompanying drawings, in which:

FIG. 6 is a table illustrating change in a configuration of an adjusting circuit unit according to an exemplary embodiment;

DETAILED DESCRIPTION OF THE EXEMPLARY EMBODIMENTS

Figure 1:
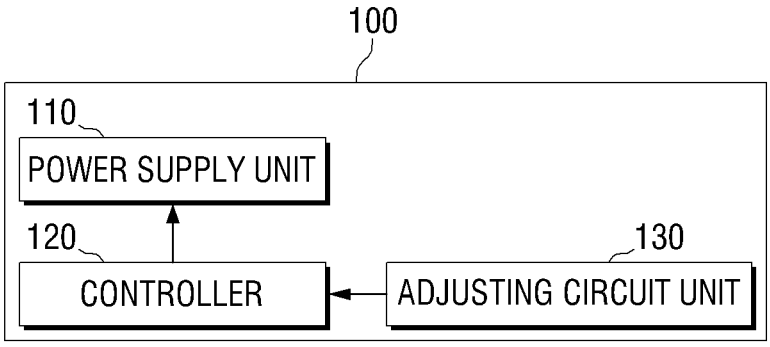
FIG. 1 is a block diagram illustrating a power supply apparatus for common use according to an exemplary embodiment.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since that would obscure the exemplary embodiments with unnecessary detail.

FIG. 1 is a block diagram illustrating a power supply apparatus 100 for common use according to an exemplary embodiment. The power supply apparatus for common use 100 includes a power supply unit 110, a controller 120, and an adjusting circuit unit 130.

The power supply unit 110 directly supplies a current to a connected display unit (not shown). A current supplied to a backlight unit is adjusted according to a size of a display panel which will receive light from the backlight unit. Specifically, the current output from the power supply unit 110 may be changed by changing a combination of a plurality of resistances included in the adjusting circuit unit 130, which will be described in detail later.

The controller 120 controls the power supply unit 110 to provide an output voltage changed by the adjusting circuit unit 130 to the backlight unit.

The adjusting circuit unit 130 is able to change the current to be supplied to the backlight unit. The adjusting circuit unit 130 has a plurality of resistances. The plurality of resistances are combinable so that a current changeable according to a size of a display panel of a display apparatus can be output. Also, the adjusting circuit unit 130 includes a voltage source, the plurality of resistances connected between opposite ends of the voltage source in series, and connecting nodes arranged between the resistances. The connecting nodes are selectively connectible so that a connection relationship between the resistances can be changed.

The power supply apparatus 100 for common use may include a connector unit (not shown). The connector unit connects the power supply unit 110 to the backlight unit and may use a wire harness. However, the wire harness is merely an example and the connector unit may have various connecting configurations.

Also, the connector unit is connected to the connecting nodes, which are arranged between the plurality of resistances included in the adjusting circuit unit 130, so as to be able to change the connection relationship between the resistances.

The backlight unit may include any of various light sources including a light emitting diode (LED). For example, a cold cathode fluorescent lamp (CCFL), an external electrode fluorescent lamp (EEFL), an electroluminescence ELP, a flat fluorescent lamp (FFL), and a hot cathode fluorescent lamp (HCFL) may be used for the backlight unit. Also, the number of resistances included in the adjusting circuit unit 130 is variable if various combinations thereof are possible, and also is not limited to a specific value.

Figure 2:
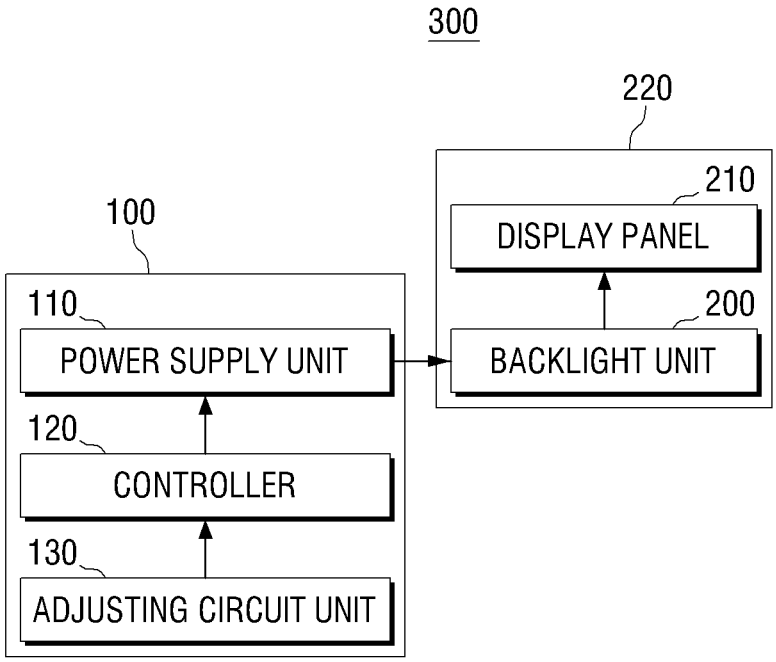
FIG. 2 is a block diagram illustrating a display apparatus according to an exemplary embodiment.

FIG. 2 is a block diagram illustrating a display apparatus 300 according to an exemplary embodiment. As shown in FIG. 2, the display apparatus 300 includes the power supply apparatus 100 for common use and a display unit 220. The power supply apparatus 100 includes the power supply unit 110, the controller 120, and the adjusting circuit unit 130, as described above with reference to FIG. 1, and the display unit 220 includes a display panel 210 and a backlight unit 200.

Figure 3:
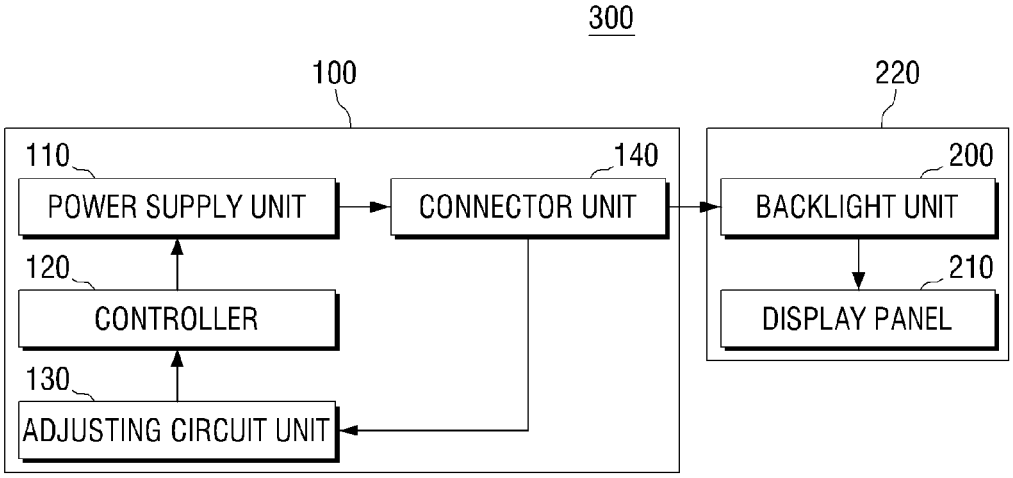
FIG. 3 is a block diagram illustrating a display apparatus according to another exemplary embodiment.

Since the power supply apparatus 100 has been described above with reference to FIG. 1, a detailed description thereof is omitted here and will be provided again when explaining FIG. 3.

The power supply unit 110 included in the power supply apparatus 100 supplies a current to the display unit 220. The current to be supplied may be changed according to the size of the display panel 210. In other words, since a current to be supplied to the backlight unit 200 should be changeable according to the size of the display panel 210, the power supply unit 110 changes the current as described above, thereby providing a current as needed in order to operate the display unit 220 normally.

The display panel 210 converts a video signal into visual information and transmits the visual information. The display panel 210 may be a liquid crystal display (LCD). The LCD, which is a transmissive type display element, displays a desired image on a screen by adjusting an amount of light passing through a liquid crystal layer by refractive anisotropy of a liquid crystal molecule.

The backlight unit 200 provides backlight for displaying an image on the display panel 210. In particular, the size and the configuration of the backlight unit 200 are different according to the size of the display panel 210 and accordingly a required driving voltage is also different. In this case, the backlight unit 200 receives a necessary driving current from the power supply apparatus 100 and provides backlight to the display panel 210.

In this embodiment, the display panel 210 is described as an LCD, but this should not be considered as limiting. Any display panel can be applied that requires backlight.

FIG. 3 is a block diagram illustrating a display apparatus 300 according to another exemplary embodiment. The display apparatus 300 of FIG. 3 further includes a connector unit 140 in addition to the elements of the display apparatus 300 of FIG. 2.

As shown in FIG. 3, the connector unit 140 supplies an output current output from the power supply unit 110 to the display unit 220. Also, the connector unit 140 is connected to the adjusting circuit unit 130 to change a magnitude of the output current output from the power supply unit 100.

Specifically, the connector unit 140 is connected to the plurality of resistances included in the adjusting circuit unit 130. More specifically, the connector unit 140 is connected to the connecting nodes connected between the resistances so that the connector unit 140 can change a connecting configuration of the plurality of resistances included in the adjusting circuit unit 130. In other words, various circuit configurations of different combinations can be provided by short-circuiting or open-circuiting the connecting nodes between the resistances.

As described above, the output current output from the power supply unit 110 is adjusted by changing the configuration of the adjusting circuit unit 130.

Since the output current should be changed as needed in the display unit 220, the connector unit 140 controls the adjusting circuit unit 130 in consideration of the size of the display panel 210 to generate a desired output current.

Figure 4:
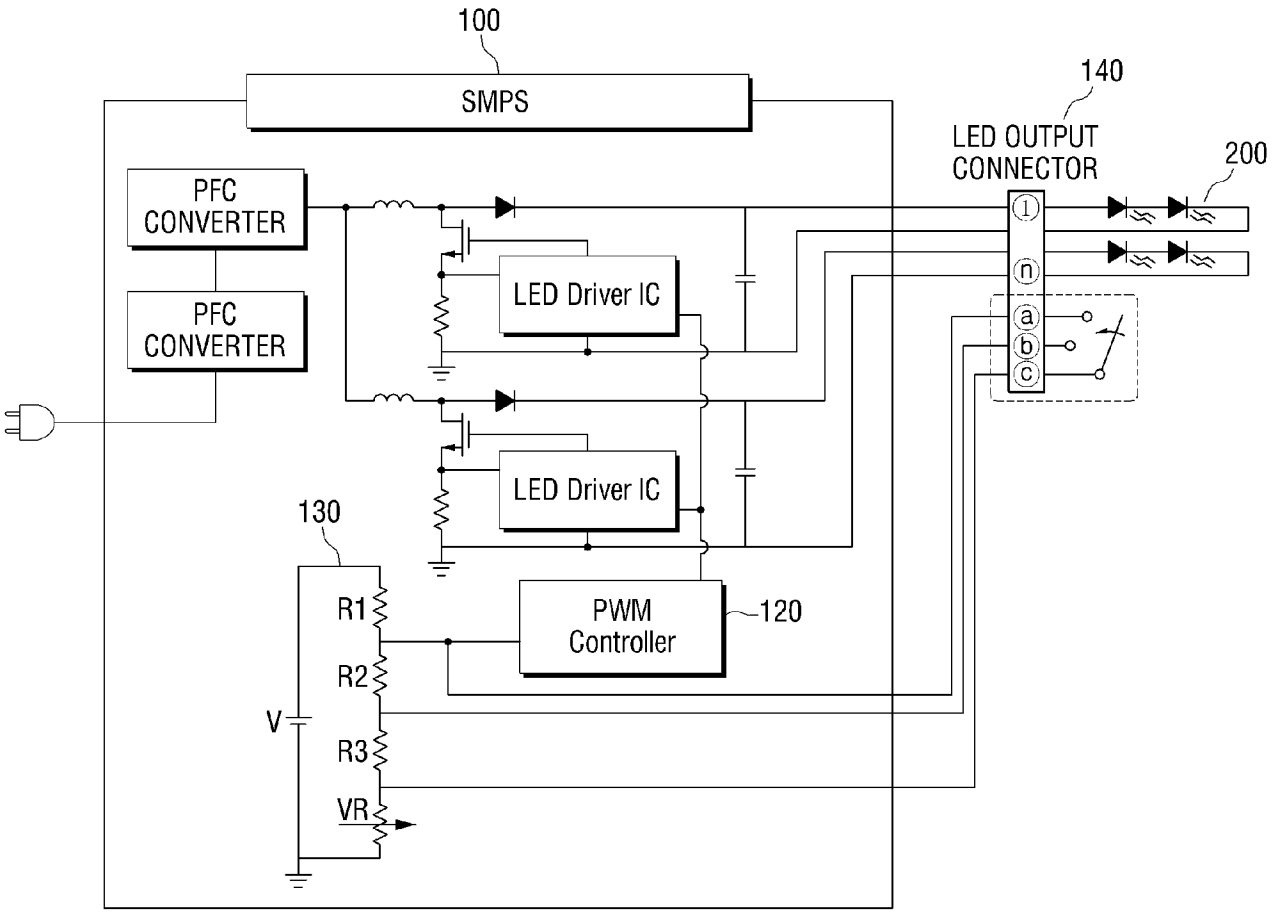
FIG. 4 is a circuit diagram of a display apparatus according to an exemplary embodiment.

FIG. 4 is a circuit diagram of the display apparatus 300 according to an exemplary embodiment. In FIG. 4, the controller 120 of FIGS. 1 to 3 is illustrated as a pulse width modulation (PWM) controller and the connector unit 140 is illustrated as an LED output connector. The adjusting circuit unit 130 includes a circuit that includes four resistances R1, R2, R3, and VR and a voltage source V. The backlight unit 200 includes a plurality of light emitting units.

The connector unit 140 provides the output current from the power supply unit 110 to the backlight unit 200 and also changes the circuit configuration of the adjusting circuit unit 130. Accordingly, the connector unit 140 includes a connecting configuration of connecting the power supply unit 110 and the backlight unit 200 and a connecting configuration of connecting to the adjusting circuit unit 130, as shown in FIG. 4.

A method for changing the configuration of the adjusting circuit unit 130 by the connector unit 140 will be explained later with reference to FIGS. 5A to 5D and FIG. 6.

The controller 120 controls the power supply unit 110 to supply different currents according to change in the circuit configuration of the adjusting circuit unit 130. In other words, referring to FIG. 4, a different voltage is input to the controller 120 from the voltage source V according to change in the configuration of the plurality of resistances, and the controller 120 controls the power supply unit 110 to change the output current according to the input voltage.

The connecting configuration of the connector unit 140 with the adjusting circuit unit 130 may be implemented in the form of hardware or software including a switch configuration.

The circuit diagram of FIG. 4 is merely an example of the most simplified circuit and may be implemented in various forms. In particular, the adjusting circuit unit 130 may include more or fewer resistances. Also, if more resistances than in FIG. 4 are included in the adjusting circuit unit 130, the configuration of the connector unit 140 is also changed. Accordingly, the connecting configuration of the resistances included in the adjusting circuit unit 130 may have more diverse combinations.

Hereinafter, the configuration of the adjusting circuit unit 130, which is changed by adjusting the connector unit 140, will be explained with reference to FIGS. 5A to 5D and FIG. 6. FIGS. 5A to 5D are enlarged views of the connector unit 140 of FIG. 4. Also, FIG. 6 is a table illustrating change in the configuration of the adjusting circuit unit 130 according to an exemplary embodiment.

In this embodiment, it is assumed that four display panels W, X, Y, Z with different sizes are provided. The display panels may require different driving currents in order to be operated normally, as described above. The connector unit 140 of FIGS. 5A to 5D is connected to the connecting nodes between the resistances R1, R2, R3, and VR included in the adjusting circuit unit 130, via connecting points a (140-1), b (140-2), and c (140-3).

Figure 5A:
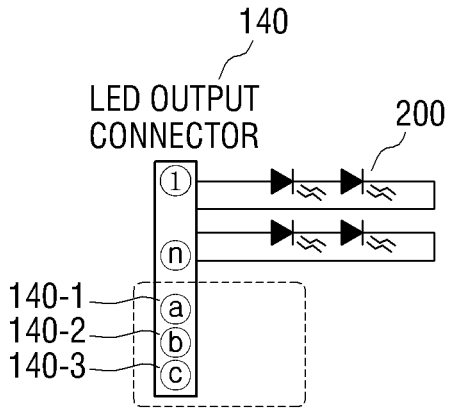
FIGS. 5A to 5D are enlarged views of a connector unit of FIG. 4.

Referring to FIG. 5A, all of the connecting points of the connector unit 140 are open-circuited. In this case, a voltage V*(R2+R3+R4)/(R1+R2+R3+VR) is input to the controller 120 from the adjusting circuit unit 130. Based on the input voltage V*(R2+R3+R4)/(R1+R2+R3+VR), the controller 120 controls the power supply unit 110 to generate an output current of a magnitude of 'w'. The output current of the magnitude of 'w' is supplied to the backlight unit 200 through the connector unit 140. The output current of the magnitude of 'w' corresponds to a current that is needed to operate the backlight unit 200 and the display unit 220 including the display panel 210 of 'W' inch.

Figure 5B:
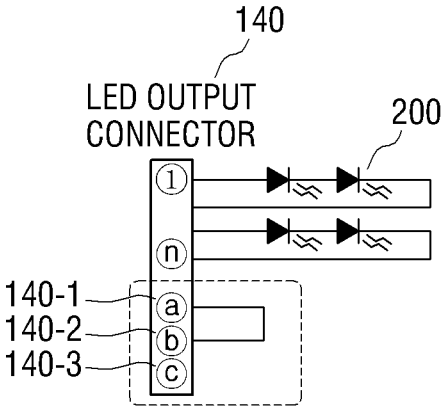

Referring to FIG. 5B, only the connecting points a (140-1) and b (140-2) of the connector unit 140 are short-circuited. In this case, a voltage V*(R3+VR)/(R1+R3+VR) is input to the controller 120 from the adjusting circuit unit 130. Based on the input voltage V*(R3+VR)/(R1+R3+VR), the controller 120 controls the power supply unit 110 to generate an output current of a magnitude of 'x'. The output current of the magnitude of 'x' is supplied to the backlight unit 200 through the connector unit 140. The output current of the magnitude of 'x' corresponds to an operating current that is needed to operate the backlight unit 200 and the display unit 220 including the display panel 210 of 'X' inch normally.

Figure 5C:
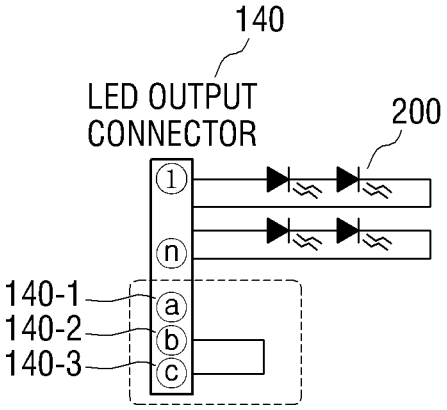

Referring to FIG. 5C, only the connecting points b (140-2) and c (140-3) of the connector part 140 are short-circuited. In this case, a voltage V*(R2+VR)/(R1+R2+VR) is input to the controller 120 from the adjusting circuit unit 130. Based on the input voltage V*(R2+VR)/(R1+R2+VR), the controller 120 controls the power supply unit 110 to generate an output current of a magnitude of 'y'. The output current of the magnitude of 'y' is supplied to the backlight unit 200 through the connector part 140. The output current of the magnitude of 'y' corresponds to an operating current that is needed to operate the backlight unit 200 and the display unit 220 including the display panel 210 of 'Y' inch normally.

Figure 5D:
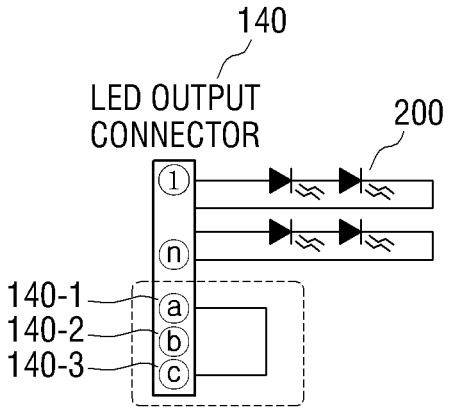

Finally, referring to FIG. 5D, only the connecting points a (140-1) and c (140-3) are short-circuited. In this case, a voltage V*VR(R1+VR) is input to the controller 120 from the adjusting circuit unit 130. Based on the input voltage V*VR (R1+VR), the controller 120 controls the power supply unit 110 to generate an output current of a magnitude of 'z'. The output current having the magnitude of 'z' is supplied to the backlight unit 200 through the connector unit 140. The output current of the magnitude of 'z' corresponds to an operating current that is needed to operate the backlight unit 200 and the display unit 220 including the display panel 210 of 'Z' inches normally.

FIG. 6 is a table summarizing the above explanation. As described above, the connecting circuit unit 130 has various connecting combinations by the control of the connector unit 140 and the controller 120 controls the power supply unit 110 to generate the output current suitable for the size of the display panel based on the input voltage changed according to the connecting combination.

As mentioned above, the present disclosure is not limited to the configurations of FIGS. 5A to 5D. In other words, as the number of resistances increases, the number of connecting combinations increases. Therefore, it should be noted that the table of FIG. 6 may be modified.

Figure 7:
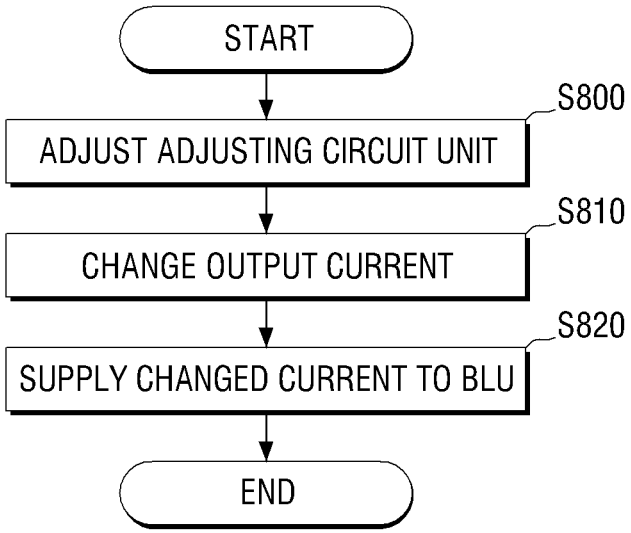
FIG. 7 is a flowchart illustrating a power supplying method for common use according to an exemplary embodiment.

FIG. 7 is a flowchart illustrating a power supplying method for common use according to an exemplary embodiment. FIG. 7 illustrates only fundamental operations of the power supplying method for common use.

Specifically, the adjusting circuit unit 130 is adjusted (S800) and thus an output current is changed (S810). The operation of changing the output current by adjusting the adjusting circuit unit 130 has been described above. Briefly, the input voltage to the controller 120 is changed by combining the resistances of the adjusting circuit unit 130 in various ways and the controller 120 controls the power supply unit to change the output current according to the input voltage.

After that, the current output from the power supply unit 110 is supplied to the backlight unit 200 (S820). Specifically, the output current supplied to the backlight unit 200 may be supplied through the connector unit 140.

Figure 8:
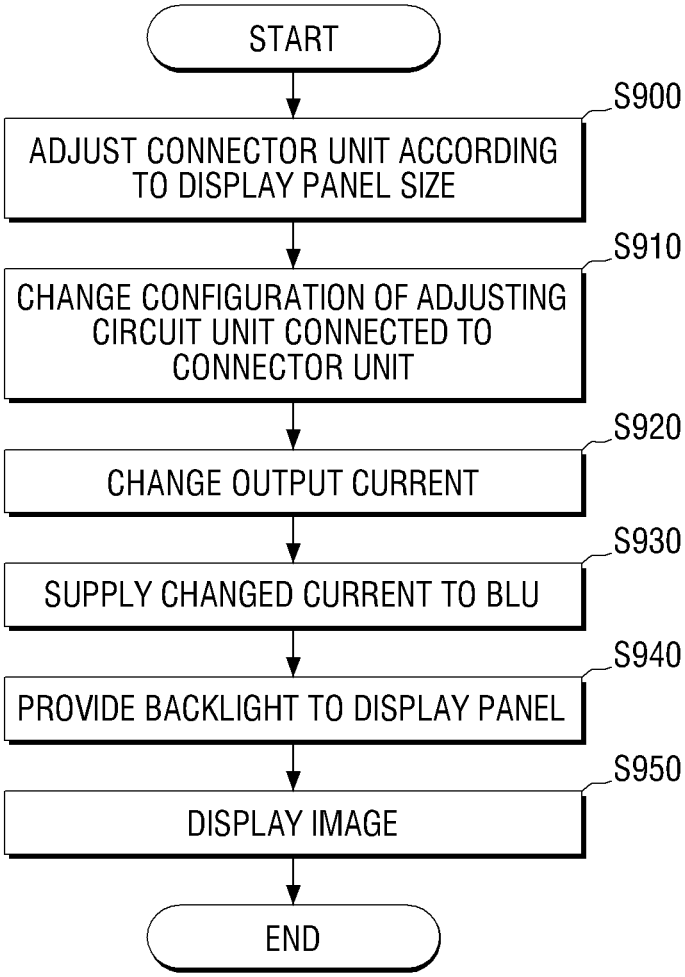
FIG. 8 is a flowchart illustrating a power supplying method for common use according to another exemplary embodiment.

FIG. 8 is a flowchart illustrating a power supplying method for common use according to another exemplary embodiment. FIG. 8 illustrates the operations of FIG. 7 in detail.

The connector unit 140 is adjusted according to the size of the display panel 210 (S900). The configuration of the adjusting circuit unit 130 connected to the connector unit 140 is changed (S910). Next, as described above, the output current from the power supply unit 110 is changed (S920).

The changed output current is supplied to the backlight unit 200 through the connector unit 140 (S930). The backlight unit 200 supplies backlight to the display panel 210 using the supplied current (S940). The display panel 210 displays a video signal using the backlight supplied from the backlight unit 200 (S950).

According to the above-described exemplary embodiments, the power supply apparatus for common use, which can adjust the output current easily and can be used commonly for various display apparatuses, is provided. Therefore, a manufacturing process can be efficiently improved and thus productivity increases and a labor cost and a manufacturing cost can be reduced.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A power supply apparatus for common use, comprising:
a power supply unit;
a controller which controls the power supply unit; and
an adjusting circuit unit which adjusts a voltage to be supplied to the controller using a plurality of resistances which are combinable in different ways, thereby adjusting a magnitude of a current output from the power supply unit.

2. The power supply apparatus as claimed in claim 1, wherein the plurality of resistances are combinable so that a current, a magnitude of which is changeable according to a display size of a display apparatus to which the power supply apparatus is applied, is output.

3. The power supply apparatus as claimed in claim 1, wherein the adjusting circuit unit comprises:
a voltage source;
the plurality of resistances which are connected between both ends of the voltage source in series; and
a plurality of connecting nodes which are formed by connection between the voltage source and the plurality of resistances,
wherein the plurality of connecting nodes are selectively connected so that a connection relationship between the plurality of resistances is changed.

4. The power supply apparatus as claimed in claim 3, further comprising a connector unit which connects the power supply unit to a backlight unit,
wherein the connector unit is connected to the plurality of connecting nodes so as to change the connection relationship between the plurality of resistances.

5. The power supply apparatus as claimed in claim 4, wherein the backlight unit comprises a light emitting diode (LED) light source and the power supply unit and the connector part are connected to each other via a wire harness.

6. A display apparatus comprising:
a display panel;
a backlight unit which provides backlight to the display panel; and
a power supply unit for common use which comprises an adjusting circuit unit comprising a plurality of resistances, and provides a current of a magnitude corresponding to a combination state of the plurality of resistances to the backlight unit.

7. The display apparatus as claimed in claim 6, wherein the plurality of resistances are combinable so that a current, a magnitude of which is changeable according to a size of the display panel, is output.

8. The display apparatus as claimed in claim 6, further comprising a connector unit which connects the power supply unit and the backlight unit,
wherein the connector unit comprises a plurality of connecting points connected to connecting nodes formed between the plurality of resistances, and a combination state of the plurality of resistances is adjusted according to a connection state between the plurality of connecting points.

9. The display apparatus as claimed in claim 8, wherein the connector unit is connected to the power supply unit via a wire harness.

10. The display apparatus as claimed in claim 6, wherein the plurality of resistances are at least three resistances.

11. The display apparatus as claimed in claim 6, wherein the backlight unit comprises an LED light source.

12. A power supplying method for common use of a display apparatus comprising a power supply unit for common use for supplying a current to a backlight unit, the method comprising:

changing an output current by adjusting an adjusting circuit unit comprising a plurality of resistances; and supplying the changed current to the backlight unit.

13. The method as claimed in claim 12, wherein the plurality of resistances are combinable so that a current, a magnitude of which is changeable according to a panel size of the display apparatus, is output.

14. The method as claimed in claim 12, wherein a combination state of the plurality of resistances is adjustable.

15. The method as claimed in claim 12, wherein the changing the current comprises changing a combination state of the plurality of resistances by adjusting a connector unit which is included in the display apparatus to connect the power supply unit and the backlight unit.

16. The method as claimed in claim 15, wherein the connector unit is connected to the power supply unit via a wire harness, wherein the plurality of resistances are at least three resistances, wherein the backlight unit comprises an LED light source.

* * * * *